United States Patent [19]

Polley

[11] Patent Number: 4,976,494

[45] Date of Patent: Dec. 11, 1990

[54] FORWARD RECUMBENT POSTURE POD

[76] Inventor: Robert F. L. Polley, Suite 15-A, 1100 University St., Seattle, Wash. 98101

[21] Appl. No.: 385,725

[22] Filed: Jul. 26, 1989

[51] Int. Cl.[5] ..... A47D 1/00

[52] U.S. Cl. ..... 297/464; 297/195; 297/296; 297/328; 297/392; 297/488

[58] Field of Search ..... 297/195, 294, 296, 302, 297/325–329, 345, 392, 464, 465, 487, 488

[56] References Cited

U.S. PATENT DOCUMENTS

| | | | |
|---|---|---|---|
| 1,964,424 | 6/1934 | Borah | 297/294 X |
| 3,071,410 | 1/1963 | Gaskins | 297/195 |
| 3,163,409 | 12/1964 | Running et al. | 297/302 X |
| 3,754,787 | 8/1973 | Garber | 297/217 X |
| 4,160,553 | 7/1979 | Fleisher | 297/5 X |
| 4,416,465 | 11/1983 | Winiecki | 297/464 X |
| 4,674,800 | 6/1987 | Ensign | 297/454 X |
| 4,858,991 | 8/1989 | Boyerson | 297/195 |

*Primary Examiner*—Peter R. Brown
*Attorney, Agent, or Firm*—Christensen, O'Connor, Johnson & Kindness

[57] ABSTRACT

The present invention relates to a forward recumbent posture pod (10) for supporting the anterior torso of an infant residing therein while allowing for substantially unrestricted movement of the infant's limbs and head. The forward recumbent posture pod comprises a pod (12) slidably secured to one end of an arc-shaped spring (14), with the other end of the spring pivotally secured to a base (20) to space the pod away from the base. An infant rests in a cavity (22) of the pod with the infant's legs projecting downwardly through openings (30). The forward recumbent posture pod is adjustable between a fully upright position in which the infant's weight is primarily supported by a bottom portion (28) of the pod and a fully inclined position in which the infant's weight is primarily supported by an anterior portion (24) of the pod. Positioning of the posture pod in the upright, inclined, or intermediate positions is affected by selectively adjusting the depth of insertion of the spring into a channel (48) located in the pod, and selectively placing an adjustment rod (74) located between the spring and base into one of a plurality of adjustment grooves (72) formed across positioning bars (70) secured to the base, causing the spring to rotate upwardly away from the base to adjust the angle of incline of the pod with respect to the base. The pod includes a posterior portion (32) and side portions (34) to restrain backwards and sideways movement away from and off of the posture pod.

3 Claims, 4 Drawing Sheets

FORWARD RECUMBENT POSTURE POD

BACKGROUND OF THE INVENTION

The present invention relates to a forward recumbent posture pod for supporting the anterior torso of a person resting therein while permitting unrestricted movement of the person's arms, legs and head, and more particularly, to a forward recumbent posture RP for infants during the first year of life.

Full-term newborn infants generally have well developed posterior muscles of the neck and trunk. However, newborn infants generally have weak anterior neck muscles, and if lying or held supine with its face up, is unable to lift its head. A newborn infant left in the supine position is relatively helpless, only able to move its arms and legs and unable to view the world around it. Newborn infants left in this position tend to grow irritable and restless.

In contrast, a full-term newborn infant that is seated or being held with his or her torso supported and forwardly inclined is able to lift and support its head, and turn its head from side-to-side to look about. Infants supported in this forward recumbent position are able to move their bodies in a swimming motion and intake the sensory stimulation surrounding it such as their mother's voices. Infants so positioned tend to find this posture highly pleasurable, and are far less likely to be irritable and restless.

Conventional infant seats, exercisers, and swings are not designed to recognize the limited development of a baby's anterior neck muscles or to take advantage of the baby's strong posterior neck and trunk muscles. Typical infant seats support a baby reclined backwards in a semi-supine position, while infant swings and exercisers tend to support an infant in an upright or semi-reclined position.

One conventional configuration of an infant exercise seat is disclosed by U.S. Pat. No. 3,528,657, issued to Krupsky, which discloses an infant swing wherein the infant is seated with its back vertically upright, or alternately, in a fully supine reclined position.

An alternate conventional configuration that provides anterior support for a person resting in a semi-inclined recumbent position is disclosed in U.S. Pat. No. 3,733,104, issued to Carstensen. The body support disclosed in that patent provides an inclined board upon which a person rests his or her full frontal body. However, depending on the board's configuration, the support does not allow free movement of the legs, or at most provides for movement of the legs only as a means of propelling the support board when mounted as a mobile walker. In addition, the arms and head rest upon slanted board surfaces that restrict their free downward movement. Further, such a board would be unsafe for young infants as the infants are not restrained from sliding off the board sideways or from falling off the board backwards as a result of back arching.

SUMMARY OF THE INVENTION

The present invention has been developed to solve the aforementioned limitations and problems of conventional infant seats and exercisers. The present invention discloses a forward recumbent infant posture pod that supports the anterior of an infant's torso while allowing the infant substantially unrestricted movement of its arms, legs, and head. The posture pod comprises a base to which one end of an arc-shaped spring is pivotally secured, and an upwardly concave support member, slidably secured to the second end of the spring and spaced away from the base by the spring, for cradling the infant.

In the preferred embodiment, the support member is a unitary pod forming a cavity, with two openings included in the base of the cavity so that an infant may be inserted into the pod with its legs protruding through the openings. The pod has an anterior portion against which the infant's torso rests and a bottom portion passing between the infant's legs to support the infant's buttocks. The pod also includes side and posterior portions surrounding the sides and back of the infant respectively, to prevent the infant from sliding to either side out of the pod or falling backwards out of the pod.

The first end of the arc-shaped spring is tangential to, and pivotally secured to, the base. The second end of the spring is tangential to the posterior portion of the pod, with the pod slidably secured to the inside radius of the spring. This configuration causes the pod to be spaced away from the base, with the anterior portion of the pod inclined forwardly from a true vertical position. When an infant is resting in the pod, its weight is supported by the anterior portion of the pod, which covers the infant's shoulders, chest, and stomach, as well as by the bottom portion of the pod, which supports the infant's buttocks. The infant's head and arms protrude above the pod and are substantially unrestrained. Due to the upward spacing of the pod by the arc-shaped spring, the infant's arms and legs are elevated above the base for free mobility. The flexibility of the arc-shaped spring allows the infant some freedom to gently undulate the pod up and down slightly by moving its arms, legs, neck and head, entertaining the infant with the pod's responsive movement.

Two positioning means are included to allow adjustment of the posture pod to increase or decrease the incline of the pod. Two adjustment bars are secured to the base on either side of and parallel to the first end of the curved spring. A plurality of grooves, oriented perpendicular to the first end of the spring, are formed across the top of the adjustment bars. An adjustment rod is located between the first end of the spring base, and rests in one set of the grooves. This causes the spring to rotate upwardly away from the base, increasing the forward incline of the attached pod with respect to the base. The incline of the pod is selectively adjusted by moving the adjustment bar to the desired set of grooves formed across the adjustment bars.

The position of the pod may be further adjusted to change its angle of incline by selecting the point of attachment of the pod to the second end of the spring. A channel is formed within the anterior of the pod, terminating in an opening in proximity to the bottom portion of the pod, into which the second end of the arc-shaped spring is slidably inserted. An adjustment knob is threadably inserted through the posterior portion of the pod and may be tightened down against the second end of the spring. The angle of incline of the pod is adjusted by inserting the second end of the spring to different depths within the channel and then tightening the adjustment knob, locating the pod at the desired positions along the arc of the spring.

By moving the adjustment rod to select the amount of rotation of the spring away from the base, and slidably adjusting the depth of insertion of the spring into the channel formed in the anterior portion of the pod, the angle of incline of the pod with respect to the base can be selectively adjusted to place the pod in a fully upright position, a fully inclined position, or intermediate positions therebetween. In the fully upright position, the anterior portion of the support member is inclined just slightly from an orthogonal to the base. In the fully inclined position, the anterior portion of the support member is inclined so as to be approaching a parallel to the base.

The posture pod includes a plurality of elongated stabilizing outriggers that are pivotally secured to the underside of the base and rotatably positionable to increase the area of the base as required for added stability. When the posture pod is adjusted so as to be in or near its fully upright position, the stabilizers may be rotated to project beyond the rear edge and sides of the base. When the posture pod is adjusted to be in or near its fully inclined position, the stabilizers may be rotated to project beyond the front edge and sides of the base.

In an alternate embodiment, a plurality of elongated stabilizing outriggers are slidably secured to the underside of the base, and are positionable to increase the area of the base to the front, the sides and the rear simultaneously for maximum stability.

The posture pod is primarily for use by infants from age one or two weeks through about age six months, in which the infant's arms, torso, and neck have usually developed sufficient strength to lift the infant's head and upper body upwardly from the prone position. Use of the posture pod during this period facilitates development of the infant's muscles while allowing the infant safe and pleasurable use of its limited abilities. As the infant matures and develops, its posterior neck and back strength increases and the posture pod is preferably forwardly inclined further and further towards its fully inclined position.

Padded liners, conforming to the interior contour of the pod, may be detachably inserted into the pod for padding and absorbency. The use of liners of varied thicknesses allow the pod to be adjusted to accommodate infants of differing sizes.

BRIEF DESCRIPTION OF THE DRAWINGS

The invention will presently be described in greater detail, by way of example, with reference to the accompanying drawings in which.

DETAILED DESCRIPTION OF THE PREFERRED EMBODIMENT

Figure 1:
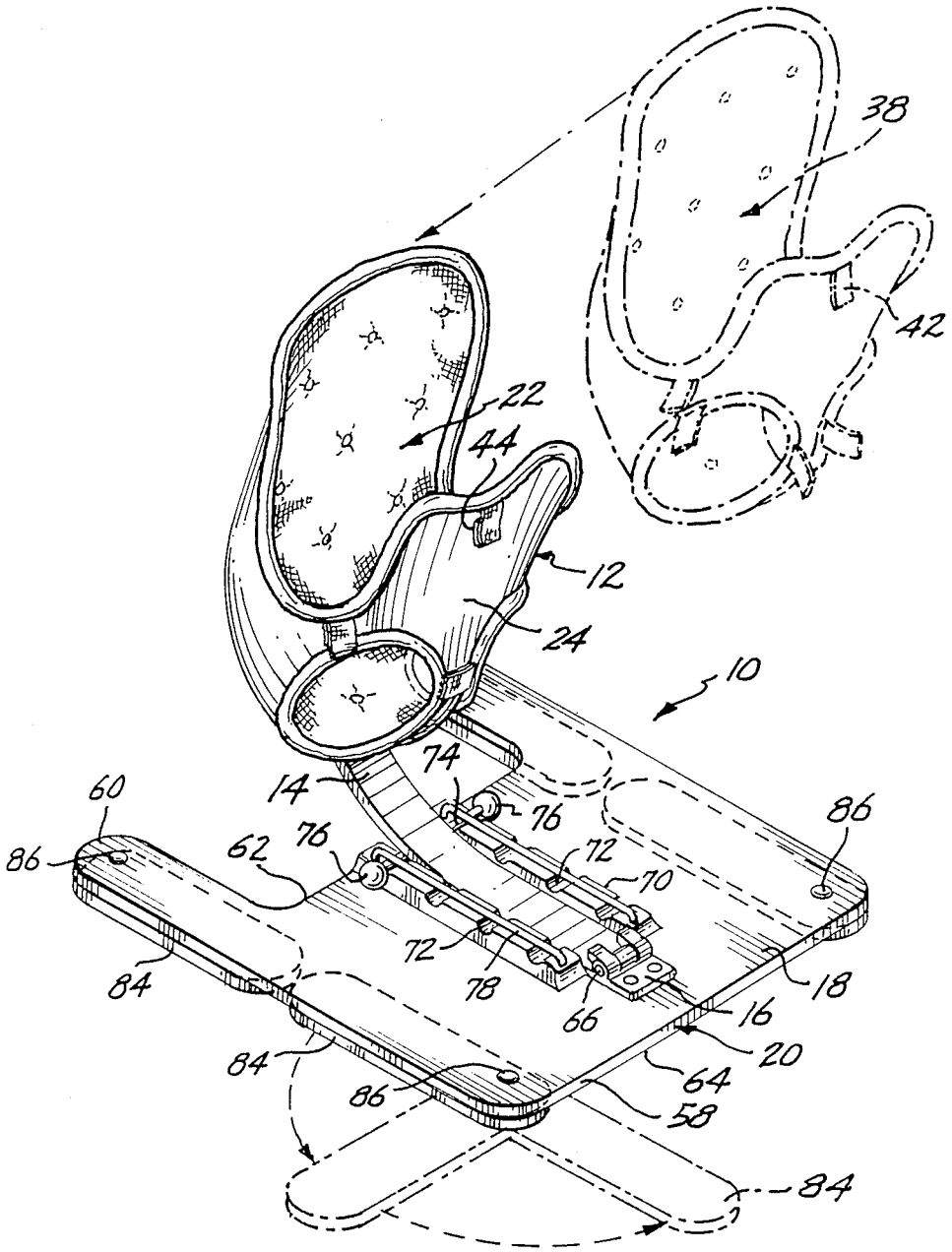
FIG. 1 is an isometric view of the posture pod in its fully upright position, with dashed lines showing movement of the stabilizing outriggers and contour of the padded liner.

FIG. 1 illustrates a preferred embodiment of a forward recumbent posture pod 10. A unitary pod 12 is secured to and elevated by an arc-shaped spring 14 that is in turn pivotally secured by a hinge 16 to the upper surface 18 of a substantially flat base 20.

The pod 12 is preferably constructed of a high-strength thermoplastic, but could alternately be made of any high-strength lightweight material, such as glass fiber reinforced polyester resin, aluminum, or steel wire mesh. The base 20 is likewise preferably constructed of a high-strength thermoplastic, but may alternately be constructed of other strong, lightweight materials, such as wood, glass fiber reinforced thermosetting plastic, or sheet steel. The arc-shaped spring 14 is formed from an elongated strip of a suitable material such as fiber reinforced polyester resin or spring steel.

Figure 3:
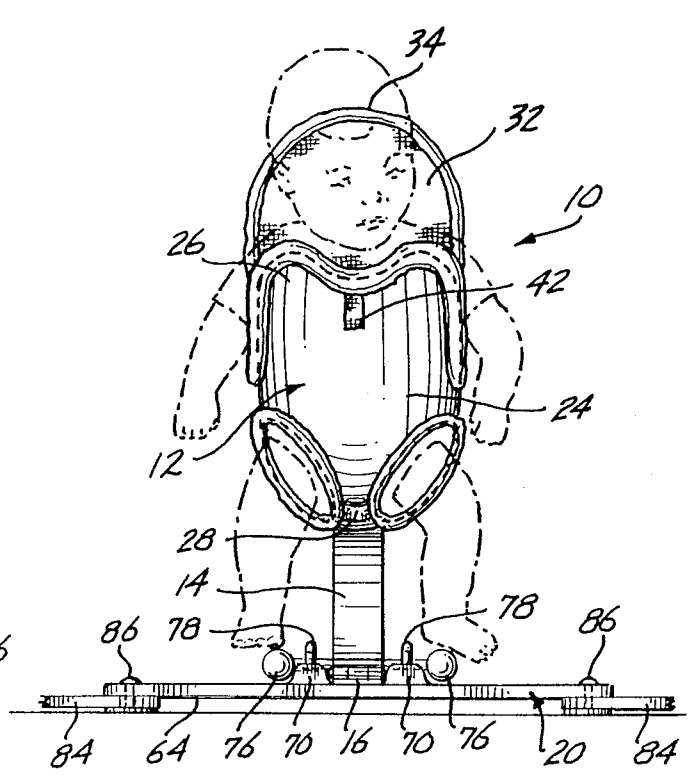
FIG. 3 is a front elevation view of the posture pod in its fully upright position.
Figure 2:
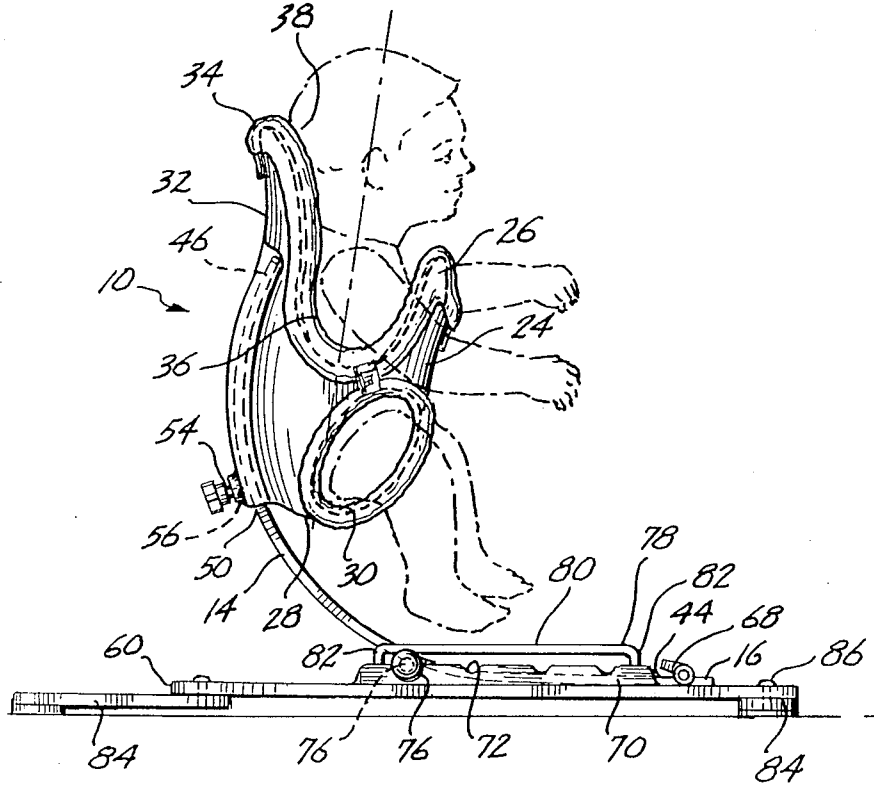
FIG. 2 is a side elevation view of the posture pod in its fully upright position.

The pod 12 forms a cavity 22 into which an infant is inserted. Referring to FIGS. 2 and 3, which illustrate side elevation and front elevation views, respectively, of an infant resting within posture pod 10, the unitary pod 12 includes an anterior portion 24 for supporting the front of the infant's torso. The anterior portion 24 is contoured to cover the infant's abdomen and chest, and terminates along its uppermost edge in two roughly semicircular shoulder extensions 26 to cover and support the infant's shoulders. The unitary pod 12 has an upwardly concave bottom portion 28 that includes two circular leg openings 30. When an infant is seated in the posture pod, its legs project through openings 30 and its buttocks rest in the bottom portion 28.

The pod 12 also includes a posterior portion 32, rising upwardly from the bottom portion 28, and parallel to anterior portion 24, to cover the back, neck and base of the head of the infant. The uppermost edge 34 of the posterior portion 32 is flared outwardly from the pod 12 to avoid an abrupt edge should the infant's head strike that portion of the pod 12. The anterior portion 24 and posterior portion 32 are joined on either side by two narrow side portions 34 of the pod 12. Two open-ended, semicircular arm channels 36 are formed between the anterior portion 24 and posterior portion 32 above the side portions 34. When an infant is inserted into the pod 12, its arms project through the arm channels 36 for substantially unrestricted movement.

Referring again to FIG. 1, the posture pod 10 includes a padded liner 38 that is formed to replicate the inner contour of the cavity 22 of the pod 12, and includes two leg openings 40 corresponding to the leg openings 30 of the pod 12. In addition to providing padding and absorbency for the pod 12, the thickness of the padding material used to make the padded liner 38, such as fiberglass batting sandwiched between cloth layers, can be sized to adjust the depth of the cavity 22 to accommodate infants of a particular size. Multiple padded liners 38 of differing thicknesses can be utilized to accommodate an infant as it grows. The padded liner 38 is preferably secured to the pod 12 by a plurality of Velcro tabs 42 that are intermeshed with corresponding Velcro fasteners 44 located on pod 12. The padded liner 38 may alternately be attached by other means, such as snaps or elastic bands.

Referring to FIG. 2, it can be seen that the pod 12 is attached to, and spaced away from, the base 20 by the arc-shaped spring 14. The arc-shaped spring 14 has a first end 44 pivotally attached to the base 20 by hinge 16 and a second end attached to the posterior portion 32 of pod 12. The posterior portion 32 of the pod 12 has an elongated channel 48 formed within that is centered along the midline of posterior portion 32. Elongated channel 48 has a cross-sectional area matching that of the arc-shaped spring 14, and follows a curved path corresponding to the curvature of the arc-shaped spring 14. The elongated channel 48 terminates at opening 50 in proximity to the bottom portion 28 of the pod 12. An adjustment knob 52 with threaded shank 54 is threadably inserted through a hole 56 passing from the outside of the pod into the channel 48 in proximity to opening 50. The second end 46 of the spring 14 is inserted through the hole 50 into the channel 48 and is secured by tightening adjustment knob 52. The depth of insertion of the second end 46 of the spring 14 into the channel 48 locates the pod 12 along the arc formed by the spring 14, and can be adjusted to change the position and incline of the pod 12, as shall be explained subsequently in greater detail.

The base 20 illustrated in the preferred embodiment of FIG. 1 has a substantially square perimeter, including a front edge 58 and a rear edge 60, with a weight reducing rectangular cutout 62 formed in the center of edge 60. It should be apparent that other types of bases could be utilized, including a tubular ring and cross brace or an X-shaped tree, such as those used in chairs or other implements of furniture. In addition, although not illustrated in the preferred embodiment, casters could be secured to the bottom surface 64 of the base 20 for greater mobility.

Figure 4:
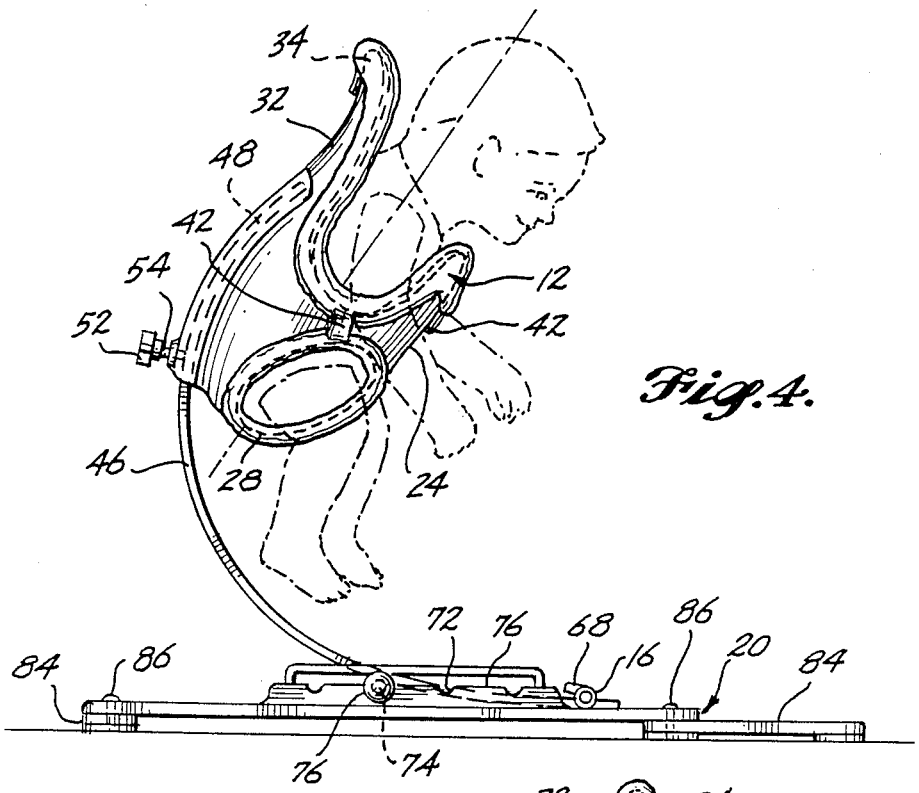
FIG. 4 is a side elevation view of the posture pod in an intermediate inclined position.
Figure 5:
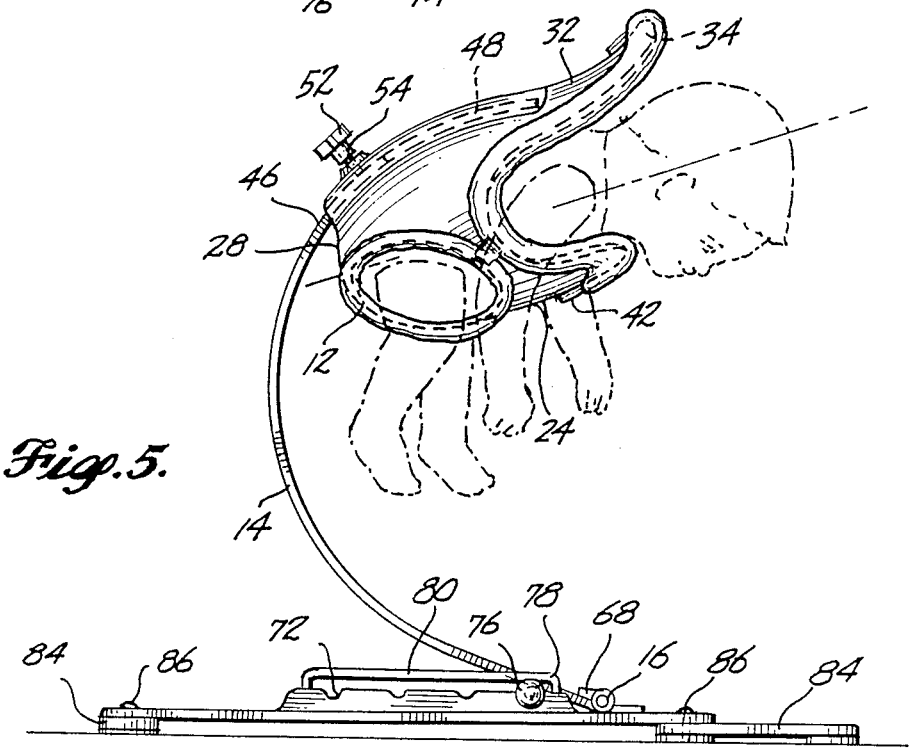
FIG. 5 is a side elevation view of the posture pod in its fully inclined position.

The second end 46 of the spring 14 is pivotally secured to the base 20 by a hinge 16 attached to the upper surface 18 of the base 20 at a midpoint along and in proximity to the front edge 58 of the base 20. A cylindrical rod 66 attached to the extreme edge of the first end 44 of spring 14 serves as the rotating half of the hinge 16. The spring 14 is pivotally secured to the base 20 so that it is normally tangential to the base 20, as illustrated in FIG. 2. The spring 14 can be rotated upwardly at hinge 16 away from its tangent with the base 20, as illustrated in FIGS. 4 and 5. A pair of lugs 68 are attached to the hinge 16 to limit the rotation of the spring 14 as illustrated in FIG. 5. The lugs 68 are secured to the upper extremity of hinge 16 and project toward and overlie slightly the first end of spring 14. When the spring 14 is rotated so that a tangent to the first end 44 creates an approximately 15° angle with the plane of the base 20, the spring 14 hits the lugs 68, preventing greater rotation and stabilizing the posture pod 10.

Referring again to FIG. 1, the posture pod 10 includes positioning means to selectively adjust the rotation of the spring 14 with respect to the base 20. Two identical parallelepiped positioning bars 70 are secured to the base 20, with one positioning bar 70 located on either side of, and parallel to, the first end of spring 14. A plurality of adjustment grooves 72 having semicircular cross sections are formed across the upper surface of each positioning bar 70. The adjustment grooves 72 have their longitudinal axes oriented perpendicularly to the tangent of the first end 44 of spring 14, and are equally spaced at increments along the length of each positioning bar 70, with the adjustment grooves 72 of one positioning bar 70 being aligned with the adjustment grooves of the other positioning bar 70. In the preferred embodiment of FIG. 1, four such sets of adjustment grooves 72 are illustrated, although other quantities of grooves may be employed.

A cylindrical adjustment rod 74 of sufficient length to span both positioning bars 70 is insertable into any set of adjustment grooves 72. As illustrated in FIG. 1, the adjustment rod 74 is inserted between the first end 44 of the spring 14 and the base 20, and is capable of being moved to rest in any set of grooves 72. Selectively placing the adjustment rod 74 into a set of adjustment grooves 72 that is closer or farther from the hinge 16 results in an increase or decrease, respectively, in the rotation of the spring 14 away from the base 20, and thus causes an increase or decrease, respectively, in the angle of incline of the pod 12 with respect to the base 20.

A spherical knob 76 is attached to each end of the adjustment rod 74 to prevent the rod from sliding out of the adjustment grooves 72. A keeper rod 78 is attached to each positioning bar 70 to prevent the adjustment rod 74 from coming free of the base 20. Referring to FIG. 2, the keeper rod 78 includes an elongated portion 80, with a short attachment portion 82 projecting perpendicularly from each end of the elongated portion 80. The keeper rods 78 are positioned parallel to and located above the positioning bars 70, with the short attachment portions 82 of each keeper rod 78 being secured to the extreme ends of the positioning bars 70. A space is thus created between the keeper rods 78 and the positioning bars 70, between which the adjustment rod 74 is disposed. The keeper rods 78 are spaced sufficiently away from the positioning bars 70 to allow free movement of the adjustment rods 74 between the various sets of adjustment grooves 72, but not so far away as to allow the spherical knobs 76 from passing through.

FIG. 2 illustrates the posture pod 10 located in a fully upright position. The second end 46 of the spring 14 is fully inserted into the elongated channel 48 formed within the posterior portion 32 of the pod 12. The adjustment knob 52 is tightened to advance threaded shank 54 to bear against spring 14 to secure the pod 12 in this position. To complete the positioning of the posture pod 10 in the fully upright position, the adjustment rod 74 is placed under the spring 14 in the set of adjustment grooves 72 located furthest from the hinge 16.

When in this fully upright position, the anterior portion 24 and posterior portion 32 of the pod 12 are inclined only slightly from orthogonal to the base, with the plane of the anterior portion 24 of the pod 12 creating an approximately 85° angle with the plane of the base 20. In this configuration, the first end 44 of the spring 14 is oriented so as to be tangential to the base 20. As illustrated in FIGS. 2 and 3, the weight of an infant residing in the posture pod 10 while located in this fully upright configuration is borne primarily by the bottom portion 28 of the pod 12. The infant is inclined very slightly forward to rest on the anterior portion 24 of the pod 12, but if the infant possesses sufficient posterior back muscles it may straighten its back to bear against the posterior portion 32 of the pod 12.

At the other extreme, FIG. 5 illustrates the posture pod 10 located in the fully inclined position. In this position, the second end 46 of the spring 14 is inserted only slightly into the channel 48 formed within the posterior portion 32 of the pod 12, where it is secured by tightening the adjustment knob 52 causing the threaded shank 54 to bear against the spring 14. When the second end 46 of the spring 14 is inserted only partially into the elongated channel 48, as shown in the inclined position, the unitary pod 12 is caused to project outwardly away from the extreme edge of the second end 46 of spring 14, following the arc cut by the spring 14 and resulting in a greater angle of incline of the pod 12 with respect to the base 20.

To complete the positioning of the posture pod 10 in this fully inclined position, the adjustment rod 74 is moved under the first end 44 of spring 14 to rest in the set of adjustment grooves 72 located in closest proximity to the hinge 16 on the base 20. This causes the spring 14 to rotate on hinge 16 away from the base 20, tilting the second end 46 of spring 14 and the unitary pod 12 towards the base 20.

When the posture pod 10 is placed in this fully inclined position, the anterior portion 24 and posterior portion 32 of the pod 12 are situated so as to approach a parallel to the base 20, with the plane of the anterior portion 24 of the pod 12 forming an approximately 5° angle with the plane of the base 20. As illustrated in FIG. 5, the weight of an infant residing in the posture pod 10 while so configured is borne primarily by the anterior portion 24 of the pod 12, and minimally by the bottom portion 28 of the pod 12. The infant's shoulders rest on the shoulder extensions 26 of the anterior portion 24 of the pod 12, with the infant's head and neck free to tilt slightly below the plane of the anterior portion 24 or to be lifted by the infant's muscles above the plane of the anterior portion 24.

The infant posture pod can be set at various intermediate positions, one example of which is illustrated in FIG. 4, located over the range spanning between the fully upright position of FIG. 2 and the fully inclined position of FIG. 5. This adjustment is completed by moving the adjustment rod 74 to the desired set of adjustment grooves 72 intermediate between the grooves 72 that are closest and furthest to the hinge 16, and adjusting the depth of insertion of the second end 46 of the spring 14 into the channel 48.

For added safety when utilized with heavier infants, the posture pod 10 preferably also includes a plurality of elongated outrigger members 84 for stabilizing the posture pod 10, as illustrated in FIG. 1. The elongated outriggers 84 are pivotally secured by pins 86 to the bottom surface 64 of the base 20 at each of its corners. These outriggers 84 may be pivoted to be positioned underneath the base 20 when not required, or pivoted to project outwardly from the base 20 along the plane of the base 20 when needed for additional stabilization, as indicated by dashed lines in FIG. 1.

One example of utilization of the outriggers 84 is shown in FIG. 2, in which the posture pod 10 is located in its fully upright position. In this fully upright position, the weight of the infant tends to be centered above the rear of the base 20, so the outriggers 84 secured in proximity to the rear edge 60 of the base 20 are preferably pivoted to project outwardly from base 20 and perpendicular to the rear edge 60 to prevent the possibility of backwards tipping of the posture pod 10. In this configuration the outriggers 84 located in proximity to the front edge 58 of the base 20 may be pivoted to project outwardly from base 20 and parallel to the front edge 58 (FIGS. 2 and 3) for greater side stability of the posture pod 10 to prevent tipping to either side.

An additional utilization of the outriggers 84 is shown in FIG. 5, illustrating the posture pod 10 in its fully inclined position. In this position, the outriggers 84 located in proximity to the front edge 58 of the base 20 are pivoted to project outwardly and perpendicular to the front edge 58 to prevent forward tipping of the posture pod 10. The outriggers 84 located in proximity to the rear edge 60 of the base 20 are rotated to pivot outwardly and parallel to rear edge 60 of the base 20 to increase side stability of the posture pod 10 in this configuration. Note also that in this fully inclined position, the first end 44 of the spring 14 abuts the lugs 68 secured to the hinge 16 on the base 20 to prevent the spring 14 from further rotating away from the base 20 as an additional safety measure.

Figure 6:
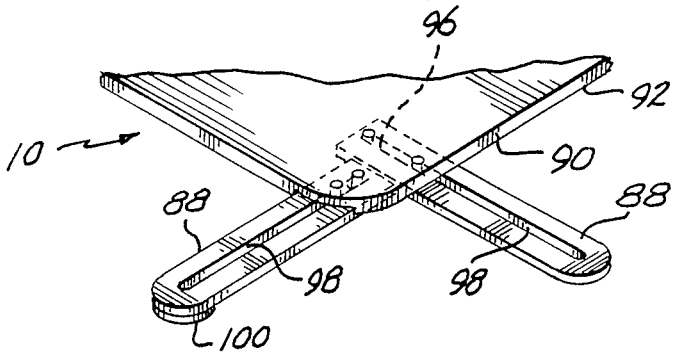
FIG. 6 is an isometric breakaway view of an alternate embodiment of the posture pod with slidably secured stabilizing outriggers.

An alternate embodiment of the posture pod 10 utilizes a plurality of elongated outrigger members 88 that are slidably secured to the bottom surface 90 of a base 92, as illustrated in FIG. 6. Two outriggers 88 are slidably secured to each corner of the base 92. The outriggers 88 are disposed so that when extended there are two outriggers 88 projecting orthogonally beyond each edge of the perimeter of the base 92, resulting in an increase in the area of the base 92 around its entire perimeter for maximum stability.

Figure 7:
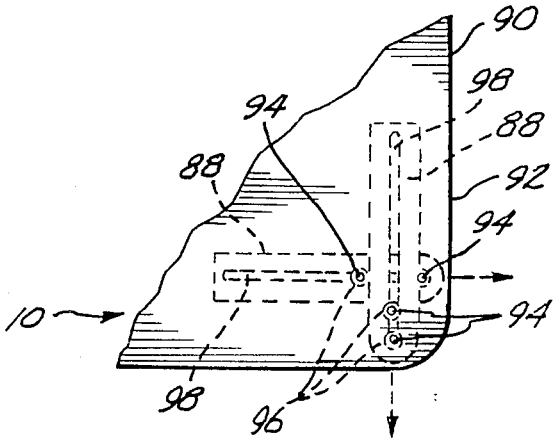
FIG. 7 is a top elevation breakaway view of the alternate embodiment of FIG. 6 illustrating the positioning of the stabilizing outriggers.

As further illustrated in FIG. 7, each outrigger 88 is secured to the base 92 by two pins 94 projecting downwardly from the bottom surface 90. Each pin 94 has a flanged head 96 that is inserted into slots 98 formed along the center line of each outrigger 88. At each corner of the base 92, a first outrigger 88 is mounted flush to the bottom surface 90 of the base 92, with a spacer 100, of the same thickness as an outrigger 88, attached to the outrigger's bottom surface. A second outrigger 88 is mounted perpendicularly to the first outrigger 88, and is spaced slightly away from the bottom surface 90 of the base 92, so that it passes under the first outrigger 88 as the outriggers 88 are slid in and out from under the base. All outriggers 88 may be slid underneath the base for compact storage.

OPERATION

The forward recumbent posture pod 10 of the present invention may be positioned in varying degrees of incline with respect to the base 20 as desired to accommodate the changing age and muscular development of the infant residing in posture pod 10. FIG. 2 illustrates the posture pod 10 in its fully upright position, as would be used for a newborn infant with very weak posterior neck and back strength, as well as for older infants that need to be in the upright position for feeding or other activities.

The infant is placed into the cavity 22 of the pod 12, with the infant's legs projecting through the leg openings 30 in the bottom portion 28 of the pod 12. The infant's arms are located between the upper extremities of the anterior portion 24 and posterior portion 32 of the pod 12. The infant is free to move its arms and legs in a substantially unrestricted manner. In this configuration, most of the infant's weight is borne on the bottom portion 28 of the pod 12, although the infant may lean against the anterior portion 24 of the posterior portion 32 of the pod 12.

To place the exterior 10 in this fully upright position, the second end 46 of the spring 14 is inserted fully into the elongated channel 48 formed in the posterior portion 32 of the pod 12, where it is secured by tightening the adjustment knob 52 to cause the threaded shank 54 to bear against the spring 14. The adjustment rod 74, located between the first end 44 of spring 14 and the base 20, is then placed into the set of adjustment grooves 72, formed across positioning bars 70, located furthest from the hinge 16 which pivotally secures the spring 14 to the base 20. In this configuration, the infant may bounce slightly up and down with the spring 14 flexing to accommodate the shifting weight, and the infant's head may be tilted forward until the infant's shoulders bear against shoulder extensions 26 of the anterior portion 24 of the pod 12.

In this position, as well as in other positions of the posture pod 10, the infant's backward movement is restrained by the posterior portion 32 of the pod 12. This prevents the infant from falling out of the pod 12 when the infant arches its back. In addition, the side portions 34 of the pod 12 prevent the infant from falling to either side out of the pod 12. The pod 12 is illustrated in FIG. 1 with the padded liner 38 installed within the cavity 22, providing padded cushioning for the infant as well as absorbency. To wash the padded liner 38 or replace it with a padded liner 38 of a different thickness, the liner 38 may be removed by undoing Velcro tabs 42.

As the infant's posterior neck and back strength increases, it is desirable to tilt the posture pod 10 forwardly towards its fully inclined position, increasing the angle of inclination of the pod 12 and the proportion of the infant's weight that is borne by the anterior portion 24 of the unitary pod 12. The posture pod 10 is illustrated in an intermediate inclined position in FIG. 4. To adjust the posture pod 10 to this position, the adjustment knob 52 is turned to back the threaded shank 54 away from the second end 46 of the spring 14. The second end 46 of the spring 14 may then be slid partially out of the elongated channel 48, causing the pod 12 to project outwardly along the arc cut by the spring 14, increasing the angle of inclination of the unitary pod 12 with respect to the base 20. The adjustment knob 52 is then tightened to cause the threaded shank 54 to bear against the second end 46 of the spring 14, securing its slidable engagement into channel 48. The rotation of the spring 14 from the base 20 is then also adjusted by grasping the knobs 76 on the adjustment rod 74, lifting adjustment rod 74 out of the set of adjustment grooves 72 in which it was located, and moving the adjustment rod forward towards the hinge 16 between the keeper bar 78 and the positioning bar 70 to a new set of adjustment grooves 72. As the adjustment rod 74 is thus advanced towards the hinge 16, the spring 14 is caused to rotate further above the base 20, increasing the angle of inclination of the unitary pod 12.

This process of adjusting the slidable insertion of the second end 46 of spring 14 into the channel 48 formed within the posterior portion 32 of the pod 12, and positioning of the adjustment rod 74 within the adjustment grooves 72 located in the positioning bars 70 on the base 20 may be repeated as desired to increase or decrease the angle of inclination of unitary pod 12. At its furthest extreme, the posture pod 10 can be positioned in its fully inclined position, as illustrated in FIG. 5. In this position, most of the infant's weight is borne by the anterior portion 24 of the pod 12. The infant's arms and legs are free to dangle and the infant's head is unsupported and may hang down slightly between the shoulder extensions 26 of the anterior portion 24. The infant may lift its head and neck as desired, restrained only by the safety limitation of the posterior portion 32.

As discussed previously, for heavier infants the outriggers 84 that are pivotally secured to the base 20 may be repositioned as the angle of inclination of the pod is changed to best support the shifting center of weight of the infant 12. When in the fully upright position of FIG. 2, the outriggers are preferentially rotated to extend the area of the base to the rear and to the sides. When the posture pod 10 is in its fully inclined position, the outriggers are preferentially rotated to extend the area of the base to the front and to the sides as shown in FIG. 5. When posture pod 10 is not in use, the outriggers 84 may be completely folded underneath the base 20 to reduce its size for storage.

In the alternate embodiment of the posture pod illustrated in FIGS. 6 and 7, outriggers 88 are slidably secured to the bottom surface 90 of the base 92. When the posture pod is in use, the outriggers 88 are slid to project outwardly from under the base 92 to increase its area all around its perimeter. When the posture pod is not in use, the outriggers 88 can be slidably retracted to underlie the base for storage.

The present invention has been described in relation to a preferred embodiment. One of ordinary skill after reading the foregoing specification will be able to affect various changes, alterations, and substitutions of equivalents without departing from the broad concepts disclosed. One example of such an alteration is the addition of a safety strap to secure the waist of the infant to the anterior portion 24 of the pod 12 to insure the safety of particularly rambunctious infants located in the fully inclined posture pod.

It should be apparent that alternate means of posterior restraint may be employed in place of the rigid posterior portion of the pod 12, such as a nylon harness, with the spring 14 in that case slidably attached directly to the anterior portion 24 of the pod 12.

It should be further apparent that an alternate elongation member may be utilized in place of the arc-shaped spring 14 to space the pod 12 away from the base 20. One such example would be an elevation rod pivotally secured to the base and also pivotally secured to the pod, with a suspension member projecting upwardly from the base and passing through a slot in the elevation rod, and a coil spring situated over the suspension member between the elevation rod and the base to maintain the spacing and provide suspension for the posture pod.

Finally, rather than a flat base 20, other types of bases conventionally utilized for chairs and other items of furniture may be utilized, such as a cross-shaped tree with rotatable casters mounted on the under surface.

In view of these and other possible changes, alterations and substitutions of equivalents, it is intended that the scope of Letters Patent granted hereon be limited only by the definition contained in the appended claims and the equivalents thereof.

The embodiments of the invention in which an exclusive property or privilege is claimed are defined as follows:

1. An apparatus for bearing an infant's weight in semi-inclined vertical position by supporting the infant's anterior torso, the apparatus comprising:

(a) a base for stabilizing the apparatus;

(b) an arc-shaped spring having a first end tangentially secured to the base and a second end projecting upwardly from the base;

(c) a support member tangentially secured to the second end of the spring and spaced from the base to elevate the infant so as to prevent the infant's limbs from resting on the base, the support member having an anterior portion against which the infant's anterior torso bears, a bottom portion extending outwardly from the anterior portion against which the infant's buttocks bear, and two lateral portions extending outwardly from the anterior portion such that the torso of the infant inclining on the support member is located between the two lateral portions to prevent the infant from sliding to either side off the anterior portion, with the support member allowing substantially unrestricted movement of the infant's head and limbs;

(d) posterior support means attached to the support member for limiting the infant's movement orthogonally away from the anterior portion of the support member;

(e) means for pivotally securing the first end of the spring to the base to allow the spring and support member to pivot between an upright position, in which the anterior portion of the support member is inclined slightly from an orthogonal to the base, and an inclined position, in which the anterior portion of the support member is inclined so as to be approaching a parallel to the base; and (f) positioning means for selectively positioning the spring and support member in the upright position, the inclined position, and intermediate positions over the range spanning between the upright and inclined positions.

2. The apparatus of claim 1, wherein the second end of the arc-shaped spring is slidably secured to the support member and is selectively positionable along the arc-shaped spring in proximity to the second end of the spring to increase the inclination of the support member toward the base.

3. The apparatus of claim 2, further comprising a plurality of stabilizing members pivotally secured to the base and positionable to extend the area of the base to stabilize the base when the elevation member and support member are substantially in the inclined position.

* * * * *